United States Patent [19]

Niehaus

[11] Patent Number: 4,735,246

[45] Date of Patent: Apr. 5, 1988

[54] FOLDABLE DISPLAY AND STORAGE RECEPTACLE

[76] Inventor: Susan A. Niehaus, 515 Del Norte Rd., Ojai, Calif. 93023

[21] Appl. No.: 869,671

[22] Filed: Jun. 2, 1986

[51] Int. Cl.[4] ..... B65D 85/02

[52] U.S. Cl. ..... 150/52 R; 206/76; 206/45.14; 206/479

[58] Field of Search ..... 206/478, 479, 566, 76; 150/52 R; 206/45.14

[56] References Cited

U.S. PATENT DOCUMENTS

| | | | |
|---|---|---|---|
| 268,454 | 12/1882 | Breidenstein | 206/566 |
| 3,900,060 | 8/1975 | Shammas | 206/479 |
| 4,296,558 | 10/1981 | Antonious | 36/50 |
| 4,324,446 | 4/1982 | Le Sage | 206/566 |
| 4,387,471 | 6/1983 | Hsu . | |
| 4,401,219 | 8/1983 | Mink | 206/566 |
| 4,566,207 | 1/1986 | Strutz | 36/50 |
| 4,642,914 | 2/1987 | Caldeira | 36/50 |

*Primary Examiner*—Joseph Man-Fu Moy
*Attorney, Agent, or Firm*—Kenneth J. Hovet

[57] ABSTRACT

A rectangular base cloth is provided with one or more cross hands. A plurality of small spaced-apart strips have a first end secured adjacent the band lower edge with an opposing free end being releasably attachable to the band. When attached to the band the strips form a series of closed loops for holding small objects such as necklaces, rings and bracelets. A closable lower pocket is provided that includes an exterior flap. The flap is readily piercable to accomodate objects having pin attachment means. The base cloth may include side covers and the overall assembly can be rolled upon itself for compact storage and easy transport. The base cloth includes connector elements for hanging and display and for securing the receptacle in its roll form.

14 Claims, 2 Drawing Sheets

FOLDABLE DISPLAY AND STORAGE RECEPTACLE

BACKGROUND OF THE INVENTION

Field of the Invention

The present invention concerns containers for small objects and, more particularly, to foldable receptacles having an assembly of engagement means for holding a variety of small articles.

Description of the Prior Art

Applicant is unaware of a portable container that keeps all types of small articles like jewelry, tangle-free, which is easy to store and which permits one to display and see the many different types, lengths, and colors of jewelry at one time for comparison before using. Jewelry can be laid out for easy viewing in a dresser drawer. However, such is obviously not transportable. Drawer storage and display also takes up much volume and, in the drawer, the jewelry can still become tangled as it is buffeted by repeated openings and closings.

There are different types and shapes of jewelry boxes which are made from wood or plastic. Some are flat, with or without drawers, and they usually have lids or doors that open in some way. Many include compartments for different types of jewelry. These jewelry boxes have limited capacity. Also, they are very limited as to the type of items that can be stored. Some are very large and cumbersome and take a lot of room on scarce counter or dresser top space.

Seeing the contents of all the drawers in the box at one time for comparison is impossible. The jewelry lays in clumps in these drawers and the true colors, length and visualization of what the jewelry will look like when in use is very difficult. Also, chains of all sizes usually tangle under these conditions, even if there is a drawer for each one.

U.S. Pat. No. 1,679,101 describes a cloth container having pockets for silverware or the like. Jewelry, especially fine chains, can become very tangled in these pockets because there is no restriction of movement. Further, chains and necklaces are not visible in the pockets to determine length, color and shape.

U.S. Pat. No. 3,525,376 discloses a soft receptacle for holding jewelry such as pins and rings. The jewelry is attached to detachable jewelry carrying members which, in turn, are attached to the receptacle body with strips of Velcro material. This invention is only suitable for use with pins and rings. Additionally, it is limited to the extent that all the rings are not individually accessible, i.e., several rings are stacked on each member. Further, it does not have any means to hang or carry chains, necklaces or bracelets. Still further, because the receptacle requires the use of carrying members, its usefulness would be limited if any are misplaced or lost.

SUMMARY OF THE INVENTION

The invention provides a foldable receptacle having integrated multiple engagement assemblies for receiving, holding and displaying a variety of objects in a secure compact manner. An elongated fastening band is mounted upon the inner face of a base of flexible material. A plurality of flexible strips are provided having a first end mounted adjacent the band and an opposing free end positioned across the band. The free ends include fastening means for releasable attachment to the band to form loop engagement means.

A closable pocket means is secured to the base having an exterior engagement flap for holding articles having pin attachment means. Cover means are also included extending from at least one lateral edge of the base material. The top part of the base includes connector means for releasably attaching the receptacle to a support structure or to a corresponding element on the base outer face when in a rolled-up mode.

DESCRIPTION OF THE PREFERRED EMBODIMENTS

Figure 1:
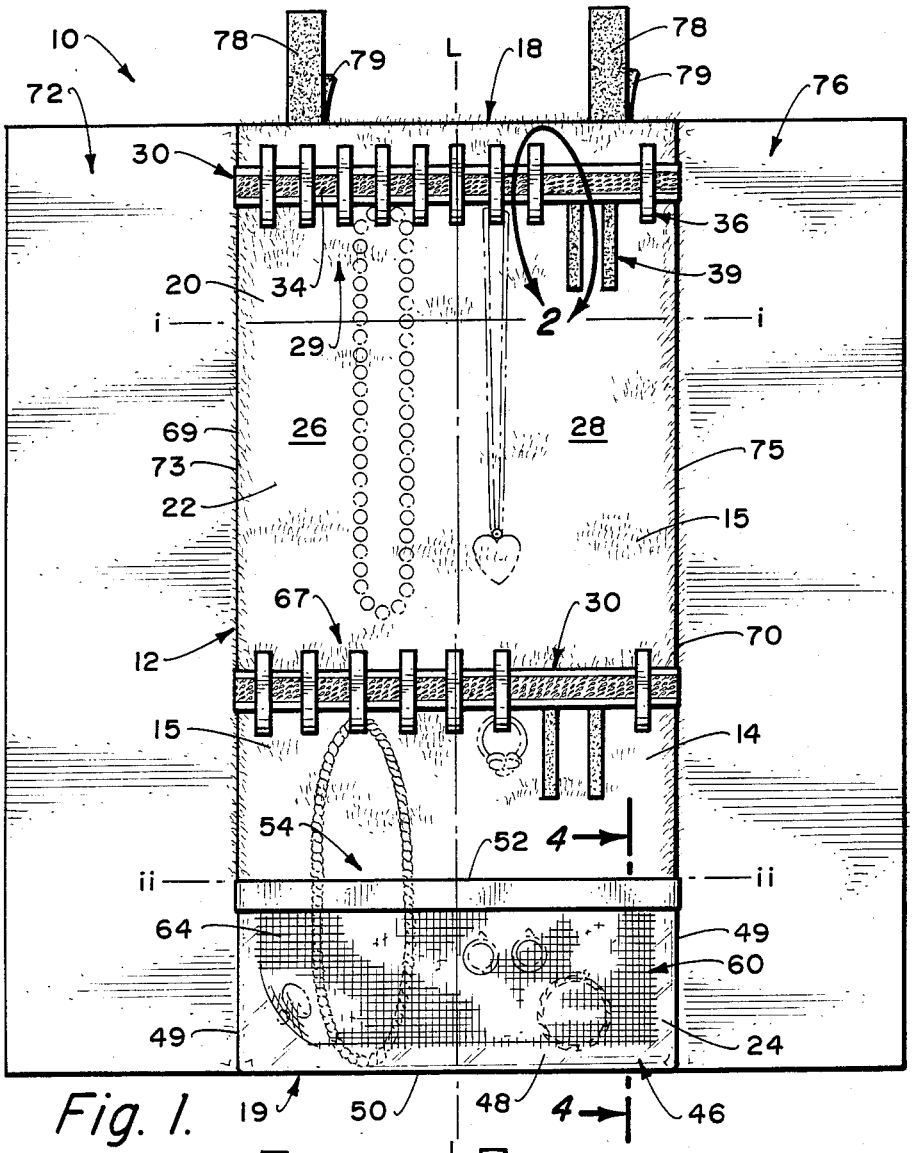
FIG. 1 is a front elevational view of the receptacle of the invention in an open position.

With reference now to the drawings and, more particularly to FIG. 1 thereof, the foldable display and storage receptacle of the invention is shown generally by reference numeral 10. The receptacle comprises a base 12 of flexible material such as cloth, leather, cellulose, cellulose/plastic or resin composites in sheet form. The overall planar shape is preferably rectangular. However, other polygonal and/or curved shapes could be used as dictated by style and functional considerations.

The base includes an inner face 14 and an outer face 16. Either or both of the faces may simply comprise a surface of the base or a separate layer of material coextensive with the base. The outer face may be decorative and/or protective in nature, e.g., water resistant, tear and abrasion resistant.

The inner face preferably includes a cushion material such as fur, fur-like, foam, sponge or heavy nap cloth to embed and hold objects such as jewelry. As shown in the drawings, the inner face comprises a sheet of fur-like material 15 stitched to an outer face comprising a sheet of cloth material. Both sheets are coextensive and form the rectangular base 12.

For convenience of definition, the base is divided by imaginary horizontal line "i,i" separating upper section 20 from midsection 22 and by horizontal imaginary line "ii,ii" separating the midsection from lower section 24. Longitudinal axis line "L,L" divides the base into a left lateral half 26 and a right lateral half 28.

Mounted by band mounting means is a first loop engagement means 29. Such means 29 includes fastening band 30 which is an elongated narrow piece of material extending horizontally across the base width. It is provided with a cooperating fastening element 32 shown as an outwardly facing continuum of either a hook or a looped cloth fastening element known, in combination, as Velcro fasteners. Corresponding parts of snaps, hooks, clasps, pin tabs and the like could also be used in place of the Velcro cloth fastening elements. It is preferable, however, that the band fastening element comprise the hook cloth compliment of the Velcro fastener. This is to provide engagement with felt-like cover means in a manner to be hereinafter described.

The band mounting means may comprise stitching shown by reference numeral 31 or adhesives, fasteners or various types of mechanical devices known in the art such as the aforementioned snaps, clasps, hooks and pin tabs. The latter, of course, would facilitate replacement or substitution of different sized bands.

The band includes a lower edge 34 adjacent to which are multiple short strips 36 of flexible material spaced-apart along the band. Each strip has a first end 38 mounted on the inner face 14 beneath band 30 and an unattached free end 39. The strips are aligned so that their longitudinal axes are about perpendicular to the longitudinal axis of the band.

Free end 39 includes a fastening element 40 at least on its outer end surface for releasable engagement with corresponding fastening element 32 on the band. The free end is moved upwardly and inwardly, as shown by arrows A, and placed transversly against the band fastening element to connect the complimentary elements. When engaged, the strip forms a loop 42 for holding an object to be stored or displayed.

Since, in the embodiment shown, the band outer face is a continuous fastening medium, substantial leeway is provided as to where the free end is pressed against the band face. This provides significant freedom in engaging various objects. Similarly, the strip fastening element 40 preferably extends over the length of the strip outer surface. Therefore, connection with band fastener 32 can occur at variable points along the strip length. In this way loop diameter can vary considerably and permit a loose or tight engagement with all types of objects.

Figure 4:
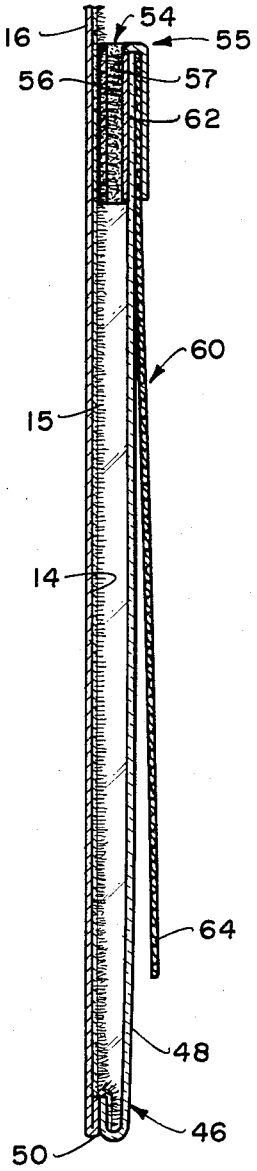
FIG. 4 is a cross-sectional view taken along lines 4—4 of FIG. 1.
Figure 5:
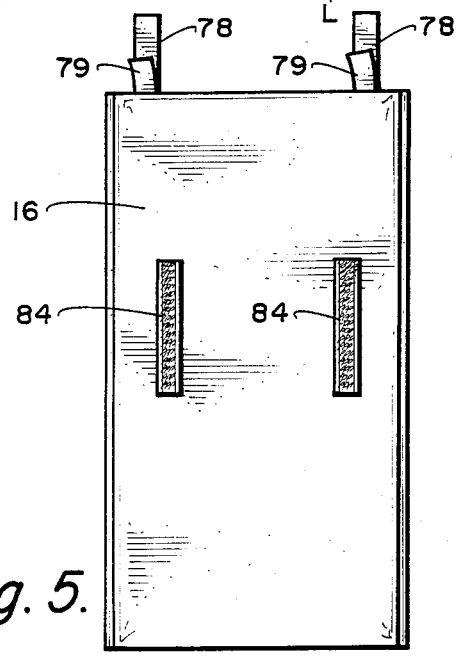
FIG. 5 is a back elevational view of the receptacle shown in FIG. 1 in a closed position.

With reference now to FIGS. 1 and 4, a pocket means 46 is mounted on the base lower section 24. As shown, a pocket is formed with an overlay sheet 48 having opposing side edges 49,49 and a bottom edge 50 secured to corresponding edges of the lower section periphery. Upper edge 52 of the overlay is horizontal and left unsecured to form a pocket top opening 54 between the base inner face and said upper edge.

Preferably, the top opening includes a closure means 55 comprising corresponding fastening elements 56,57, such as the Velcro hook/loop cloth fasteners. A respective element is secured to the overlay inside top portion and to a corresponding directly opposite portion of the base inner face. The fasteners may extend along the entire top opening, i.e., width of the base, to wholly enclose the pocket. It is desirable to have the overlay sheet constructed of transparent flexible material such as clear plastic. This facilitates identification of the small items that may be placed in the pocket.

The overlay sheet may also include an engagement flap 60. The flap is constructed of piercable material or openwork such as open weave or loosely woven cloth. This allows objects such as ear rings, brooches and tie tacks with their own pin attachment means, to be secured thereto.

As shown in FIG. 4, the flap has a proximal end 62 which is secured to the outer portion of top edge 52 by stitching or the like. The flap distal end 64 is unattached and extends downwardly a distance no greater than the height of pocket 46. The unattached end is readily lifted for access to the flap backside to facilitate connection with pin attachable objects.

Spaced-apart directly above top opening 54 proximate midsection 22 is a second loop engagement means 67. The second means may be identical in construction, arrangement and operation as the first engagement means. However, depending on the particular application and type of objects being secured, the number of strips 36, their size and spacing may be varied. Also, band 30 may be inclined across the inner face to accomodate objects of varying length.

To help secure and protect items connected to the loop engagement means, cover means are provided to overlay said items. The cover means comprise one or more sheets of flexible material secured to opposing edges of the base and sized to overlay at least a lateral half of said base. In the embodiment shown, left cover 72 is secured to left longitudinal edge 73 of the base. Right cover 76 is secured to right longitudinal edge 75. Each cover extends over at least the respective left and right lateral half of inner face 14.

It is expected that the covers are constructed of a soft material such as felt. The felt will drape over the objects and, along with cushion material 15, assist in holding each object in its place. In this regard, the cushion material should extend at least over the inner face from lower band edge 34 to lower section 24.

Figure 8:
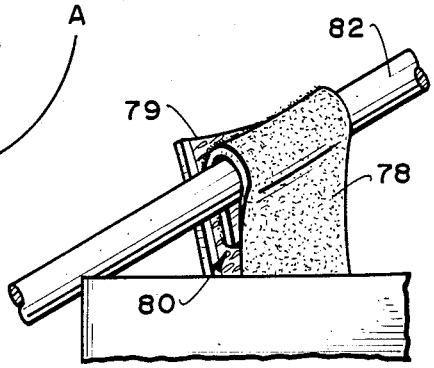
FIG. 8 is an enlarged fragmentary view taken along line 8 of FIG. 7.
Figure 7:
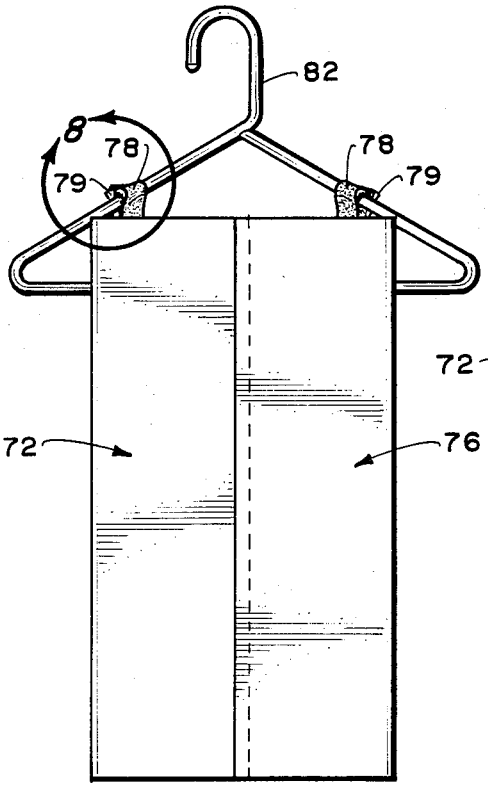
FIG. 7 is a front elevational view of the receptacle in a closed position connected to a clothes hanger.

Top part 18 of the base is provided with connector means for releasably attaching the overall receptacle to a support structure. As shown, the connector means comprises two spaced-apart pairs of corresponding hook/looped cloth fastening elements 78,79. One end of each element is secured to the top part edge with the free end of each corresponding element being connectable to each other to form a hoop 80. As best shown in FIGS. 7 and 8, the hoop encircles the arm of a clothes hanger 82 and the receptacle will hang therefrom for easy access, storage or concealment.

Outer face 16 of the base is provided with two spaced-apart roll fastening elements 84,84. Each element corresponds for engagement purposes with a respective connector element 78,78. In the case of Velcro fasteners, elements 84,84 preferably comprise the hook cloth compliment to permit attachment with the felt covers 72,76. In such case, elements 78,78 shall comprise the looped cloth compliment and elements 79,79 shall thereby comprise the hook cloth compliment.

Figure 6:
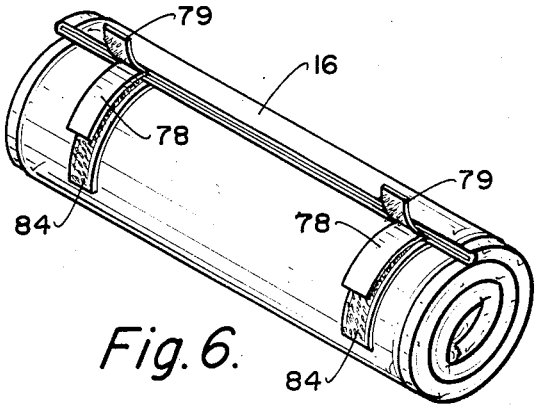
FIG. 6 is a perspective view of the receptacle of FIG. 5 secured in a roll form.
Figure 2:
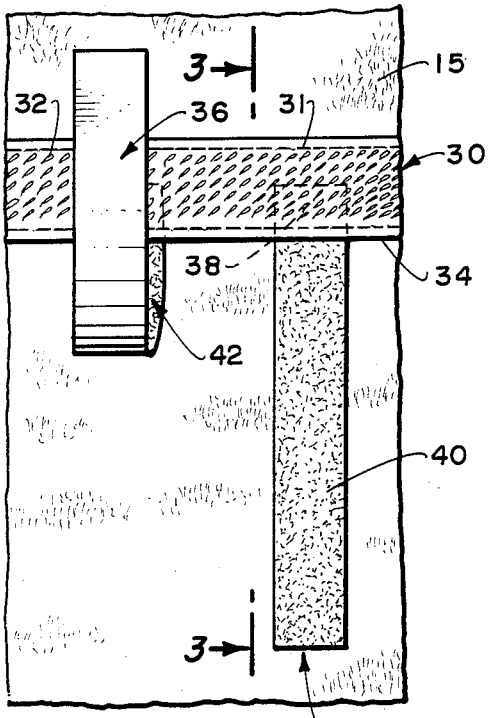
FIG. 2 is an enlarged fragmentary view taken along line 2 of FIG. 1.

The roll fastening elements are secured to the outer face in juxtaposition with respective elements 78,78 when the receptacle is in a rolled-up form as shown in FIG. 6. Although not shown, the roll fastener elements 84,84 will preferably function as above described to hold covers 72,76 against the outer face and out of the way of a user.

Figure 9:
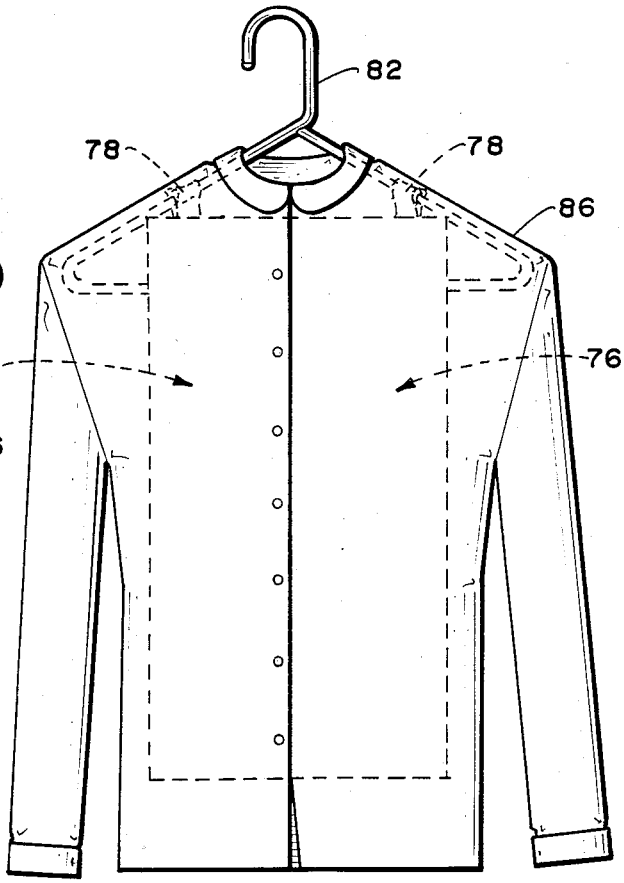
FIG. 9 is a view identical to FIG. 7 except the receptacle is hanging within a blouse on a clothes hanger.

The numerous advantages of applicant'unique receptacle construction will be apparent upon further description of its use and function. When in an unrolled mode with covers open as shown in FIG. 1, the receptacle can be readily accessed for attachment or release of objects or for viewing and display. It can be suspended from a hanger 82, as shown, or to cross bars, mirror or picture frames. In fact, it can be permanently mounted in a frame. For concealment, it can be hung or mounted behind a mirror or picture or hung from a hanger beneath a garment such as blouse 86 shown in FIG. 9.

Figure 3:
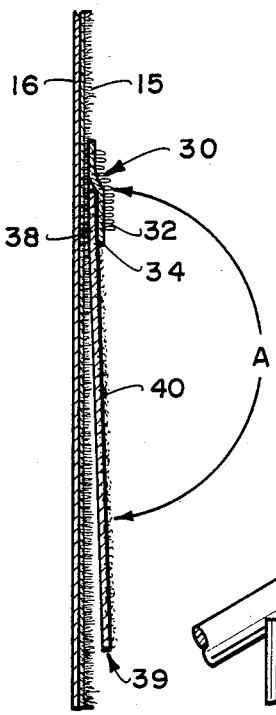
FIG. 3 is a cross-sectional view taken along lines 3—3 of FIG. 2.

It is expected that the first loop engagement means will be used for elongated closable articles such as chains and necklaces. Free end 39 will be inserted through the article opening and swung up and around toward band 30 in the direction of arrow A as shown in FIG. 3. It will be pressed against band elment 32 for engagement therewith and formation of closed loop 42. The article will lay in the cushion medium and be resistant to further movement. The cover may also be used to inhibit unwanted movement and entanglement with adjacent articles by placing it over the articles and pressing it against portions of band fastener 32 between strips 36.

To further assist in avoiding entanglement, the elongated articles may be attached to the second loop engagement means with a portion of the article being permitted to hang into pocket 48 as shown in FIG. 1. The top opening may then be closed thereover to affirmatively prevent movement.

The pocket itself may contain solid articles and/or small articles which are without pin attachment means. The closure means entirely encloses the articles within the pocket.

The pocket engagement flap can be easily lifted and pierced by the pin of a tie tack, clasped brooch, ear ring and the like. As so mounted, the objects are readily viewable while being stationary and free from loose entanglement.

For transport and storage, the covers are closed by moving them over the inner face. They may be secured against open portions of both horizontal bands 30. Base bottom part 19 is rolled upon itself toward top part 18 along longitudinal axis "L,L". Connector elements 78,78 are then pressed against roll fastener elements 84,84 and the receptacle is secured in its roll form. As so disposed, all articles contained within the receptacle will be inherently secured against movement, abrasion and entanglement.

While the invention has been described with respect to a preferred embodiment, it will be apparent that various modifications may be made without departing from the scope and spirit of the invention. Accordingly, it is to be understood that the invention is not to be limited by the specific illustrative embodiment, but only by the scope of the appended claims.

I claim:

1. A foldable receptacle for holding and displaying small objects comprising:

a base of flexible material with an inner face comprising an upper section, a midsection and a lower section;

an elongated fastening band mounted in said upper section having an outwardly facing cloth fastener surface;

a plurality of spaced-apart strips each having a first end mounted adjacent said band and a free end extending transverse to said band, said free end including a cloth fastener element which is complimentary to the band cloth fastener surface whereby said free end may be formed into a loop and releasably attached to said band; and, a pocket means mounted on the lower section of said inner face comprising an overlay sheet secured about its opposing side edges and bottom edge to said face with an unsecured top edge forming a top opening with said face having a closure means for releasably attaching said top edge to said inner face.

2. The receptacle of claim 1 including an engagement flap secured to said overlay sheet for retaining objects that include their own pin attachment means.

3. The receptacle of claim 2 wherein said engagement flap includes a proximal end which is secured to the top edge of said overlay sheet and an opposing distal end which extends freely therefrom.

4. The receptacle of claim 3 wherein said engagement flap is constructed of a piercable material.

5. The receptacle of claim 1 wherein said overlay sheet is transparent.

6. The receptable of claim 1 including a second fastening band mounted upon said midsection having an outwardly facing cloth fastener surface with a plurality of flexible strips each having a first end mounted adjacent said band and a free end extending transverse to said band, said free end including a cloth fastener element which is complimentary to the band cloth fastener surface whereby said free end may be formed into a loop and releasably attached to said band.

7. The receptacle of claim 1 wherein said base is polygonal in planar shape with at least one of two opposing lateral edges including a cover means comprising a felt-like material secured to said lateral edge and sized to overlay at least a lateral half of said base portion.

8. The receptacle of claim 7 wherein said base is rectangular in shape with said lateral edges comprising opposing longitudinal edges.

9. The receptacle of claim 8 wherein said band extends across said inner face about perpendicular to the longitudinal edges.

10. The receptacle of claim 9 wherein said base includes a top part and a bottom part, said top part having connector means for releasably attaching said receptacle to a support structure.

11. The receptacle of claim 10 wherein said base includes an outer face having a connector element for releasable attachment to said connector means when the receptacle is rolled from said bottom part.

12. A receptacle for jewelry comprising:

a cloth base having opposing lateral edges;

loop engagement means mounted on said base comprising a band secured to said base with an outer face consisting of a band fastening element, a plurality of loops spaced along the length of said band comprising a strip of material having a first end mounted on the base adjacent said band and a free end having a strip fastening element which is complimentary to said band fastening element releasably attached to said band fastening element;

pocket means mounted on said base below said loop engagement means comprising an overlay sheet having opposing side edges and a bottom edge secured to said base with an unsecured top edge forming a top opening between said top edge and base, said top opening including closure means for enclosing said pocket means comprising complimentary cloth fastening elements secured to said top edge and a corresponding portion of said base; and, cover means comprising a cloth cover secured to the lateral edge of said base and releasably securable to at least a portion of said base.

13. The receptacle of claim 12 including another loop engagement means mounted on said base between said other loop engagement means and said pocket means.

14. The receptacle of claim 13 wherein said pocket means includes an engagement flap comprising a piercable material having a proximal end secured to the top edge of said overlay sheet and an unattached distal end extending about coextensive with said overlay sheet.

* * * * *